United States Patent [19]

Jaunarajs

[11] 3,997,972

[45] Dec. 21, 1976

[54] WRITING DEVICE EMPLOYING WRITING TIP MOUNTED ON FLEXIBLE ROTATING SHAFT

[76] Inventor: Janis V. Jaunarajs, 56 W. Cliff St., Somerville, N.J. 08876

[22] Filed: Feb. 19, 1975

[21] Appl. No.: 550,970

Related U.S. Application Data

[63] Continuation-in-part of Ser. No. 391,500, Aug. 24, 1973, abandoned.

[52] U.S. Cl. ..... 33/18 R; 401/52

[51] Int. Cl.[2] ..... B43K 29/00; B43K 19/00; B43L 9/00; B43L 13/00

[58] Field of Search ..... 33/18 R, 27 R, 27 L; 401/52, 80, 86, 195; 15/3, 3.53

[56] References Cited

UNITED STATES PATENTS

| | | | |
|---|---|---|---|
| 2,390,226 | 12/1945 | Smith | 15/3.53 |
| 2,805,475 | 9/1957 | Adams | 33/18 R |
| 3,297,003 | 1/1967 | Benson | 33/27 L |

FOREIGN PATENTS OR APPLICATIONS

| | | | |
|---|---|---|---|
| 28,442 | 11/1924 | France | 401/52 |
| 915,433 | 7/1954 | Germany | 15/23 |
| 545,861 | 8/1956 | Italy | 33/18 R |
| 699,017 | 10/1953 | United Kingdom | 33/18 R |

*Primary Examiner*—Harry N. Haroian
*Assistant Examiner*—Richard R. Stearns
*Attorney, Agent, or Firm*—Jackson, Jackson and Chovanes

[57] ABSTRACT

A writing device including a barrel containing a battery powered motor having a shaft extending through one end of the barrel, preferably interchangeable writing tips and a connection to the shaft by a very flexible connector. The device enables production of impressions and designs on a writing surface whose character is dependent upon the flexible connection, the tip and the writing surface, and whose variety is limited only by the will of the operator. The device is useful for example as a toy or an artist's tool.

3 Claims, 16 Drawing Figures

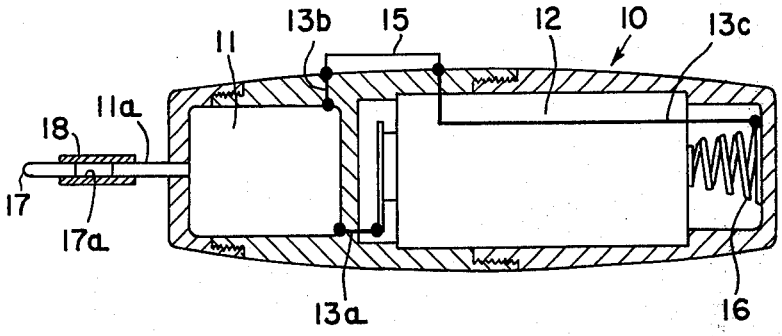
FIG. 1
FIG. 2
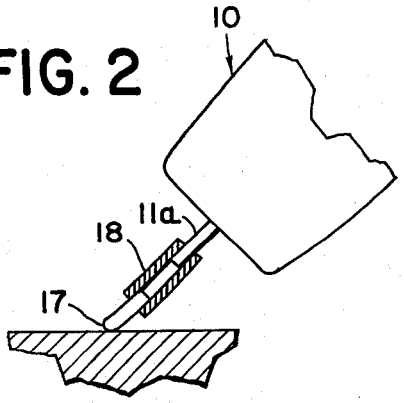
FIG. 3
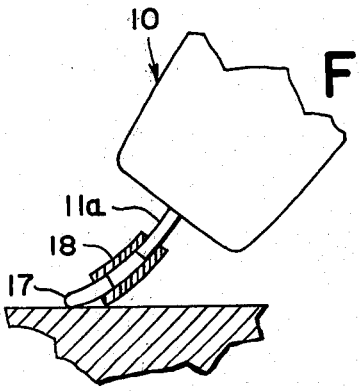
FIG. 5
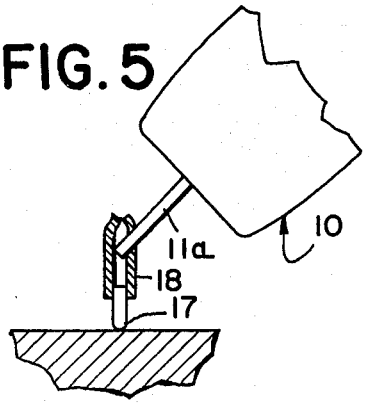
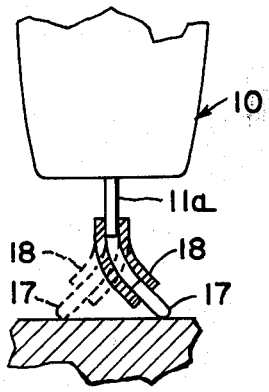
FIG. 4
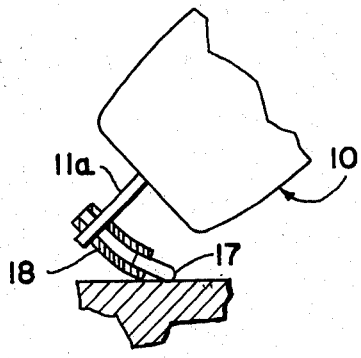
FIG. 6

FIG. 7
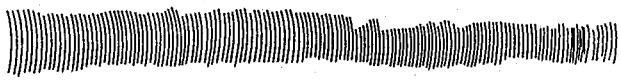
FIG. 8
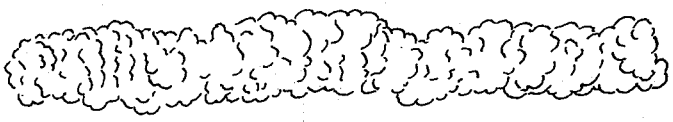
FIG. 9
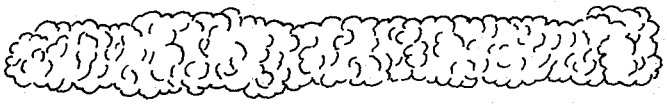
FIG. 10
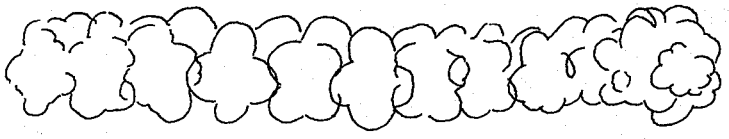
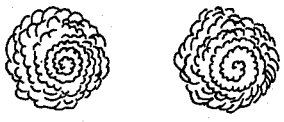
FIG. 11
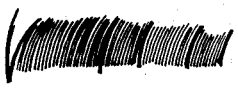
FIG. 12
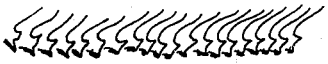
FIG. 13
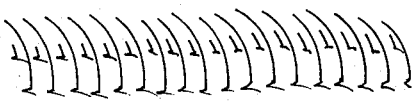
FIG. 14
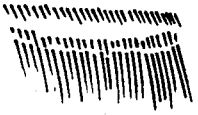
FIG. 15
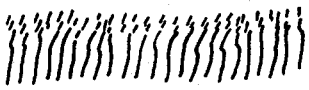
FIG. 16

WRITING DEVICE EMPLOYING WRITING TIP MOUNTED ON FLEXIBLE ROTATING SHAFT

PRIOR APPLICATION

This is a continuation-in-part of my application Ser. No. 391,500, filed Aug. 24, 1973, now abandoned, for WRITING DEVICE EMPLOYING WRITING TIP MOUNTED ON FLEXIBLE ROTATING SHAFT.

BACKGROUND OF THE INVENTION

This invention relates to a writing device and more particularly to such a device employing a writing tip mounted on a rotating shaft having a rubbery connection.

SUMMARY OF INVENTION

The wirting device of the invention employs a writing tip connected by means of a rubbery sleeve to a rotating shaft which imparts rotation to the tip, and the device includes a handle to support the shaft and tip.

In a preferable embodiment the tip is easily removable from the shaft, enabling interchangeability of a variety of tips or writing points, sizes and types, etc., such as graphite, charcoal, crayon, chalk, or porous ink carrier of the type employed in a felt tipped pen or the like. In a second preferred embodiment the handle is a barrel containing a DC motor and battery, the motor having a rigid shaft extending through one end of the barrel, and the rigid shaft being connected to a writing tip by a rubbery connector.

The device is useful, for example, as a toy or as an artist's tool.

BRIEF DESCRIPTION OF DRAWINGS

FIG. 1 is a side elevation partly in section of one embodiment of the writing device of the invention.

FIGS. 2, 3, 4, 5 and 6 are elevations of the barrel, shaft extension connector and tip in various positions.

FIGS. 7–16 show traces or marks which the marker makes on the paper in the various positions shown in FIGS. 2–6.

DETAILED DESCRIPTION OF THE INVENTION

In the drawings there is one embodiment of the invention wherein barrel 10 contains a DC motor 11 and battery 12 connected to the motor leads 13*a* and 13*b* by means of a leaf spring, and the circuit includes a coil spring 16, lead 13*c* and slide switch 15 mounted on the outside of the barrel. Coil spring 16 serves to maintain firm connection between the battery and the leaf spring as well as between the battery and itself, in a manner well known. It will be understood that the shaft can be driven in other suitable ways.

Rigid shaft 11*a*, rotatably mounted on the motor, extends through one end of the barrel 10. Shaft 11*a* may simply be an extension of the motor armature shaft, or may be connected thereto.

Alternative arrangements to that described are possible. For example, the barrel could contain an Ac motor and a line cord extending from the end of the barrel opposite the shaft end; or the barrel could support a conduit containing a flexible shaft and extending beyond the end of the barrel to a remotely located motive force.

Returning to FIG. 1, it is seen that writing tip 17 is connected to shaft 11*a* by means of a rubbery connection 18 which can flex freely. This connector is preferably a section of tubing. The rubbery connector is an elastic material such as especially pure gum, pure latex rubber or surgical rubber. Pure gum is a well known material, a form of rubber, which has no additives sufficient to interfere with the resilience. Pure latex rubber can be, for example, as in Federal Specification ZZ-T-831C-2, Type 4–5, Classes 1 or 3. Pure gum is preferable to pure latex rubber from the standpoint of length of resilient life, especially. Surgical rubber is a common well known term for the type of rubber which has been found most desirable in this application.

The base of the writing tip 17 is preferably cylindrical in shape and is of a size to fit securely into connector 18. Tip 17 may be any suitable material such as graphite, charcoal, crayon, chalk, or porous felt as already previously indicated. Tip 17 is shown in the figure as having a rounded end but it could be of any convenient shape for the desired use.

In operation the combined rotating and flexing action of the shaft imparts a circular motion to the tip. Depending on the degree of pressure exerted upon the handle, and the contact angle with the writing surface, this circular action may be maintained or may be distorted in varying degrees to give a variety of impressions or design configurations. Varying the tip from a round shape produces further variations. For example, should the tip be chisel shaped, it can be made to chatter across the surface in a roughly circular motion, although the resulting impressions are given an appearance very different from that which may be produced by skidding a round tip across the surface in smooth spirals. The size and degree of overlap of the markings or tracks on the writing surface will vary with pressure, shaft speed and the rate at which the device is drawn across the surface.

Other variations may be produced by varying the flexibility of the connector and the texture of the writing surface.

In using the improvement of my invention, the manner of use of FIG. 2 produces the scrolls of FIGS. 7 and 12. The mode of use of FIG. 3 produces the markings of FIG. 13 due to the fact that the marker 17 and the rubbery connector 18 both contact the paper.

The mode of use of FIG. 4 produces the markings of FIGS. 8, 9, 10 and 11. FIGS. 8, 9 and 10 represent the track when the marker is moved and FIG. 11 represents the track when the marker is stationary and the downward pressure is varied. The mode of use of FIG. 5 produces the markings of FIGS. 14 and 15 and the mode of use of FIG. 6 produces the markings of FIG. 16.

In some cases as in FIG. 3 the connector contacts the marking surface and also the marker contacts the marking surface simultaneously. This causes an erratic motion to produce special effects on the paper.

It will be evident that the connector set-up can be such as to give the marking tip a normally eccentric position relative to the axis of rotation of the shaft, as in FIGS. 5 and 6.

In view of my invention and disclosure, variations and modifications to meet individual whim or particular need will doubtless become evident to others skilled in the art to obtain all or part of the benefits of my invention without copying the structure shown, and I, therefore, claim all such insofar as they fall within the reasonable spirit and scope of my claims.

What I claim is:

1. A writing device comprising:

a handle, a shaft, extending beyond the handle and rotatably mounted on the handle, means for imparting rotary motion to the shaft, a writing tip, and a rubbery connector releasably connecting the writing tip to the shaft, which rubbery connector comprises a section of surgical rubber tubing, one end of which is fitted to the shaft and the other end of which is fitted to the base of the writing tip.

2. A writing device comprising:

a handle, a shaft, extending beyond the handle and rotatably mounted on the handle, means for imparting rotary motion to the shaft, a writing tip, and a rubbery connector releasably connecting the writing tip to the shaft, the writing tip being located in an eccentric position relative to the axis of rotation of the shaft.

3. A writing device comprising:

a handle, a shaft, extending beyond the handle and rotatably mounted on the handle, means for imparting rotary motion to the shaft, a writing tip, and a rubbery connector releasably and resiliently connecting the writing tip to the shaft, said connector having an outside lower edge extending over a portion of said writing tip in a place located beyond the handle, and being capable of contacting the writing surface at a different point from where the writing tip does, when the rubbery connector is pressed down against the writing surface with the shaft inclined.

* * * * *